US008099821B2

(12) United States Patent
Herzog et al.

(10) Patent No.: US 8,099,821 B2
(45) Date of Patent: Jan. 24, 2012

(54) TOOTHBRUSH, TOOTHBRUSH FILAMENT AND METHOD FOR MANUFACTURING SAME

(75) Inventors: Karl Herzog, Frankfurt am Main (DE); Ulrich Stoerkel, Bad Nauheim (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 12/950,661

(22) Filed: Nov. 19, 2010

(65) Prior Publication Data

US 2011/0061191 A1 Mar. 17, 2011

Related U.S. Application Data

(63) Continuation of application No. PCT/EP2009/003418, filed on May 14, 2009.

(30) Foreign Application Priority Data

May 20, 2008 (EP) ..... 08009217

(51) Int. Cl.
*A46B 9/04* (2006.01)
*A46B 9/06* (2006.01)

(52) U.S. Cl. ..... 15/167.1; 15/207.2; 15/DIG. 6

(58) Field of Classification Search ..... 15/167.1, 15/207.2, DIG. 6
See application file for complete search history.

(56) References Cited

U.S. PATENT DOCUMENTS 2,200,946 A * 5/1940 Bloch ..... 442/320
3,184,369 A 5/1965 Edward
4,285,892 A * 8/1981 Betsuda et al. ..... 264/443
4,745,027 A 5/1988 Maeda
5,242,235 A 9/1993 Li
6,163,918 A 12/2000 Weihrauch
2002/0182409 A1 12/2002 Gueret

FOREIGN PATENT DOCUMENTS

| | | |
|---|---|---|
| DE | 19508539 | 9/1996 |
| EP | 0035796 B1 | 9/1981 |
| EP | 0475314 | 3/1992 |
| GB | 1169106 | 10/1969 |
| JP | 2005-000310 | 1/2005 |
| WO | WO 03105996 | 12/2003 |

OTHER PUBLICATIONS

European International Search Report; date of completion of the search Oct. 15, 2008; 3 pages.

* cited by examiner

*Primary Examiner* — Randall Chin
(74) *Attorney, Agent, or Firm* — Julia A. Glazer; James E. Oehlenschlager; David M. Weirich

(57) ABSTRACT

The present invention relates to a toothbrush. The invention relates in particular to a toothbrush filament having a filament body surrounding a matrix material in which grains are embedded, wherein the matrix material and the grains have a different resistance to etching so that by etching the matrix material and/or the grains a surface structure can be created on the filament body at least in the area of the tapering end section. According to one aspect of the present invention, grains having a shell structure with a grain shell, in which is encapsulated a grain core comprising a core material different from the shell material, have been embedded in the matrix material of the filament.

12 Claims, 3 Drawing Sheets

TOOTHBRUSH, TOOTHBRUSH FILAMENT AND METHOD FOR MANUFACTURING SAME

CROSS REFERENCE TO RELATED APPLICATION

Figure 1:
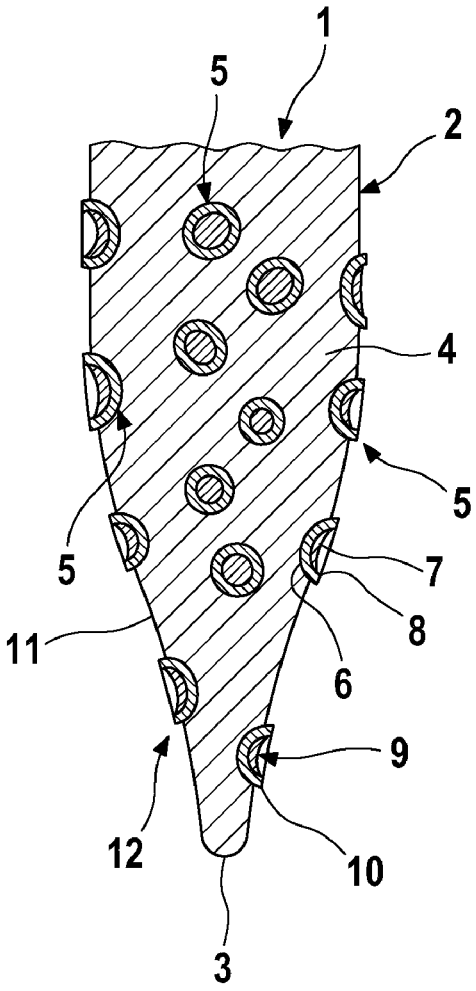

This application is a continuation application of prior co-pending International Application No. PCT/EP2009/003418, filed May 14, 2009, designating the U.S.

The present invention relates to a toothbrush. The invention relates in particular to a toothbrush filament with a filament body which has an end section tapering toward the tip of the filament and surrounds a matrix material in which grains are embedded, whereby the matrix material and the grains have a different etching resistance so that by etching the matrix material and/or the grains a surface structure can be created on the filament body at least in the area of the tapering end section. On the other hand, the invention also relates to a method for manufacturing such a toothbrush filament in which a matrix material is mixed with grains which have an etching resistance different from that of the matrix material, and a filament body is shaped from the matrix material-grain mixture; then by surface treatment, in particular etching of the filament body, matrix material and/or grain material is eroded, thereby creating a surface structure on the filament body.

The cleaning effect of a toothbrush depends on, among other things, the surface structure of the filaments, i.e., the bristles of the toothbrush. In particular, the cleaning effect of toothbrushes can be improved if the surface of the filaments is not designed to be entirely smooth but instead has a structure. The edges of the surface structure can scrape plaque from the teeth. Furthermore, the toothpaste can be applied better.

JP 2005-000310 A discloses a bristle that tapers toward its end and is used in toothbrushes in which polishing and grinding bodies made of silica, for example, are embedded in the filament body made of plastic, whereby part of the body of the grains embedded near the surface protrudes out of the body of the plastic bristle, so that the grains have a grinding and/or polishing effect on the sides of the tooth when brushing the teeth. The surface structure formed by the protruding grains is also provided in particular in the tapering end section of the bristle which is provided in toothbrushing in order to penetrate into the interdental spaces to also have the aforementioned polishing effect there. However, the grains partially exposed by etching of the bristle surface have a grinding effect which has previously been perceived as too strong. Moreover, the adhesive and/or storage effect for toothpaste and/or toothpaste foam for an improved distribution thereof has/have been limited.

DE 19508539 A1 discloses a toothbrush having filaments of an elastic plastic in which silver particles are embedded. During use, the walls of the filaments should be ground to the extent that the silver particles are exposed and can be washed out by contact with saliva. In the new state, however, the silver particles are concealed beneath the surface of the plastic filaments, so that the silver particles are exposed only by the mechanical abrasion of the plastic filaments.

EP 0035796 B1 and GB 1169106 disclosed textile fibers for weaving textiles into which crater-like surface recesses are incorporated by means of an alkaline treatment. To this end, the fibers are made of two polymers that are not mutually compatible, so that the one polymer is deposited in the form of droplets in the other polymer and the polymer that is separated in the form of droplets can be rinsed out by the alkaline solution. Meanwhile, said fibers are not suitable for toothbrushing because, first of all, the filaments lack the tapering end sections and, secondly, the drop-wise introduction of the incompatible polymer tends to achieve a rounded rinsing effect, where the abrasive effect is limited.

Against this background, the object of the present invention is to create an improved toothbrush, an improved toothbrush filament for said toothbrush and an improved method for manufacturing such a toothbrush filament which will avoid the disadvantages of the state of the art and will improve upon the latter in an advantageous manner. In particular, a toothbrush filament with a high cleaning effect is to be created in a manufacturing process that is efficient and easy to control.

According to this invention, this object is achieved by a toothbrush filament, a toothbrush and a method for manufacturing such a toothbrush filament. Preferred embodiments of the invention are the subject matter of the dependent claims.

It is thus proposed that matrix material and grain material at the filament surface should be eroded by etching by means of an etchant to thereby create the desired surface structure. The grain material advantageously has a lower etching resistance than the matrix material so that the grains are eroded to a greater extent by etching, so that recesses forming a negative image of the grain contour are formed on the filament surface. These pockets, which are formed by at least partially etching away the grains on the filament surface, can serve to store toothpaste or toothpaste foam and thus distribute it better over the teeth. Furthermore, the edges of the etched, essentially crater-like recesses form meshing contours which can scrape away the plaque on the teeth.

Said recesses on the tapering end section of the filament body, which is intended for penetrating into the interdental spaces, are especially advantageous. In contrast with the protruding grains provided on the tapering end section, as are known from the state of the art according to JP 2005-000310, the recesses introduced into the filament surface do not prevent the filaments from penetrating into the interdental spaces. Nevertheless, an improved cleaning effect and in particular abrasion of plaque can be achieved through the scraping effect of the edges of the recesses. In etching the toothbrush filament, the grain material may essentially be etched away completely, thereby forming crater-like recesses in which the bottom of the recess is formed by the matrix material. Alternatively or additionally, at least some recesses may have a recess bottom of grain material. In this regard, the etching process is continued only as long and intensely enough, so that the grains on the filament surface are only partially etched away until recesses where the bottom is not covered by grain material are formed. In particular, concave grain end faces may be created, defining the crater-like recesses in the filament body.

Easy removal by etching of the grains can be achieved by using various grain materials. Preferably grains of a mineral limestone, in particular chalk grains, can be embedded in the matrix material, whereby the matrix material may advantageously be a polymer material that can be machined by etching but is relatively resistant to etching. In an advantageous further embodiment of the invention, the matrix material of the filaments may be polybutylene terephthalate (PBT) or polyamide (PA).

Alternatively or in addition to the aforementioned etching of recesses in the filament surface due to relatively greater etching removal of the grain material, according to another aspect of the present invention, grains having a shell structure may also be embedded in the matrix material of the filament, each of these grains having a grain shell in which a grain core of a core material that differs from the shell material is encapsulated. Grains having such a shell structure may also achieve advantages with regard to the cleaning effect on toothbrush filaments without tapering of the end section. In particular, a specially shaped surface structure can be achieved through the shell structure and/or an active ingredient embedded as core material can be released by toothbrushing.

To achieve a surface structure that is especially efficient in removing plaque, the aforementioned grains having a shell structure may be provided with a shell in which the shell material has a greater etching resistance than the matrix material of the toothbrush filament, so that in etching the toothbrush filament, protrusions formed by the shell material are formed on the filament surface. Said shell material is at most partially worn away in etching, so that the grain material remains at least partially as a protrusion.

In an advantageous manner, the shell material is worn away in etching at least to the extent that an opening is formed in the shell and the core material which is initially enclosed by the grain material is also exposed to the etchant. The core material here may advantageously have a lower etching resistance than the grain material, so that as soon as an opening has been etched in the grain shell, the core is etched away to a greater extent than the grain material. This forms, first of all, elevated protrusions which are formed by the remaining part of the shell and extend above the matrix material, while on the other hand, recesses are formed in the remaining part of the grain material and form pockets for the toothpaste and/or toothpaste foam in the manner described above. Furthermore, engagement edges, which have multiple effects and/or multiple polishing and/or grinding effects, namely on the one hand, the protruding contour of the remaining shell part and, on the other hand, the edge bordering the recesses, creating a scraping effect, are formed.

The core material may essentially be etched away completely, so that only the remaining part of the grain material is left and the bottom of the recess is formed by the shell material in the remaining granular shell part. Alternatively or additionally, some of the grains may also be etched away only to the extent that a portion of the core material remains and the recesses bordered by the shell openings have a bottom made of core material.

Alternatively or in addition to the use of an etchable core, grains having a shell structure may also be embedded in the matrix material, these grains containing as the core material an application substance for toothbrushing and/or oral dental care. In particular, active ingredients such as chlorhexidine, triclosan, fluoride or flavoring agents may be encapsulated in the grain material.

With such grains that are filled with an application substance, it may also be advantageous not to etch the granular shell at all in etching the toothbrush filament, i.e., the grain material is etched only slightly or not at all, so that it initially remains sealed. Due to the fact that the grains protrude above the surface of the matrix material of the toothbrush filament, the grains are broken up by the mechanical stress in toothbrushing, so that the application substance in the core of the grains can then escape in a defined manner.

The shell of the aforementioned grains having a shell structure may essentially consist of various materials. According to an advantageous embodiment of the invention, the shell of the grains may consist of aluminum oxide or silicon oxide or compounds thereof.

The grains embedded in the matrix material may essentially be of different sizes. To achieve a good compromise between the polishing and/or grinding effect on the one hand and adequate strength of the matrix material and/or the entire filament on the other hand, in a further embodiment of the invention, the grains and/or the recesses forming a negative image of the grains may have a diameter in the range of 0.001 to 0.1 mm, preferably 0.01 to 0.05 mm. If the grains have a shell structure in the manner described above, the grain material may have a shell thickness in the range of 0.001 to 0.05 mm, preferably 0.005 to 0.03 mm.

The depth of the recesses and/or the elevation of the grains having a shell structure may essentially also be of different dimensions. In a further embodiment of the invention, depths in the range of 0.0005 to 0.025 mm may be provided. Grains having a shell structure may have a height protruding above the matrix material in the range of 0.0005 to 0.025 mm.

Essentially the surface structure created by the grains may be provided only in the area of the tapering end section of the toothbrush filament. In a preferred further embodiment of the invention, however, it is possible for the aforementioned surface structure to extend beyond the tapering end section in an essentially cylindrical filament section, whereby according to an advantageous embodiment of the invention, essentially the entire filament may be provided with the aforementioned surface structure.

The tapering end section of the toothbrush filament may essentially have different cross sections. According to an advantageous embodiment of the invention, the taper of the end section may be designed to be conical. Instead of an end section having a circular cross section, an end section pointed into an end section pointed in a wedge shape may also be provided and may be produced, e.g., by grinding the filament body. The aforementioned conical taper in the toothbrush filament is advantageously created by etching, whereby the toothbrush filament may be immersed in a suitable etchant, for example. The conical taper and the surface structure produced by the grains are advantageously formed in the same etching operation, so that especially efficient production of the filaments can be achieved.

Figure 2:
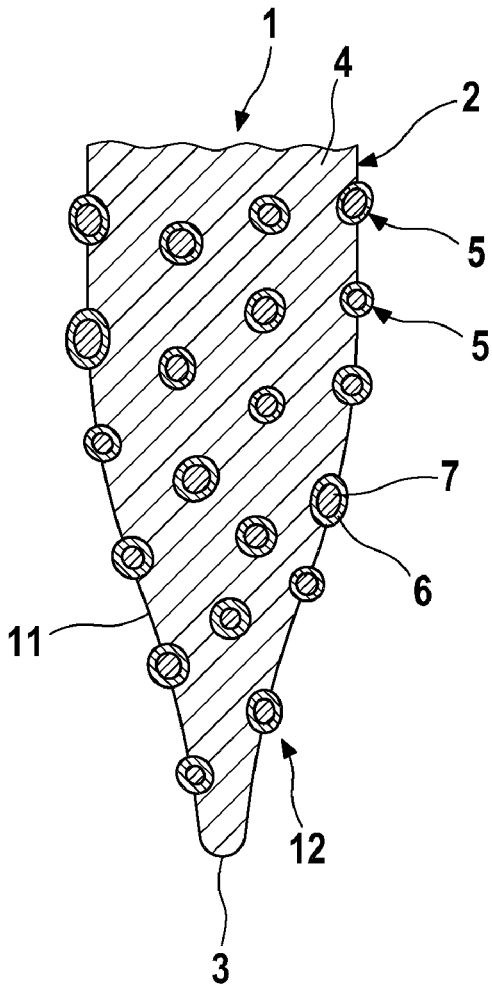
Figure 3:
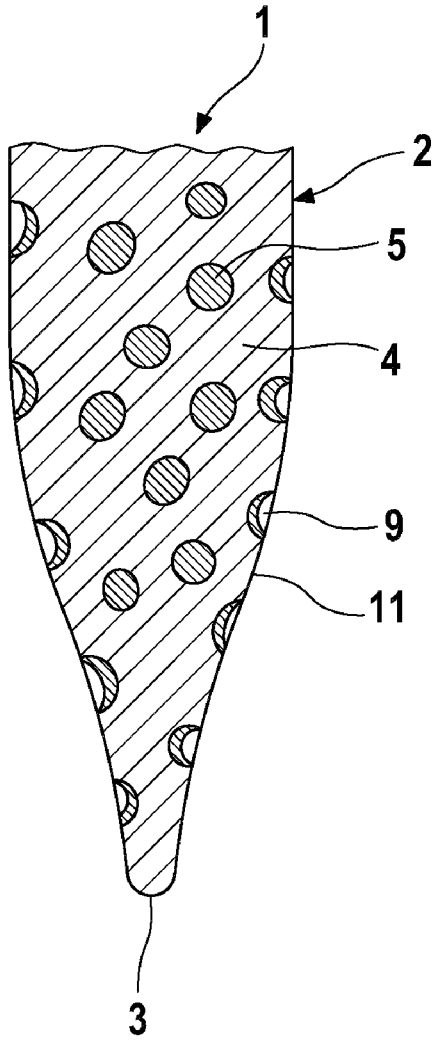
Figure 4:
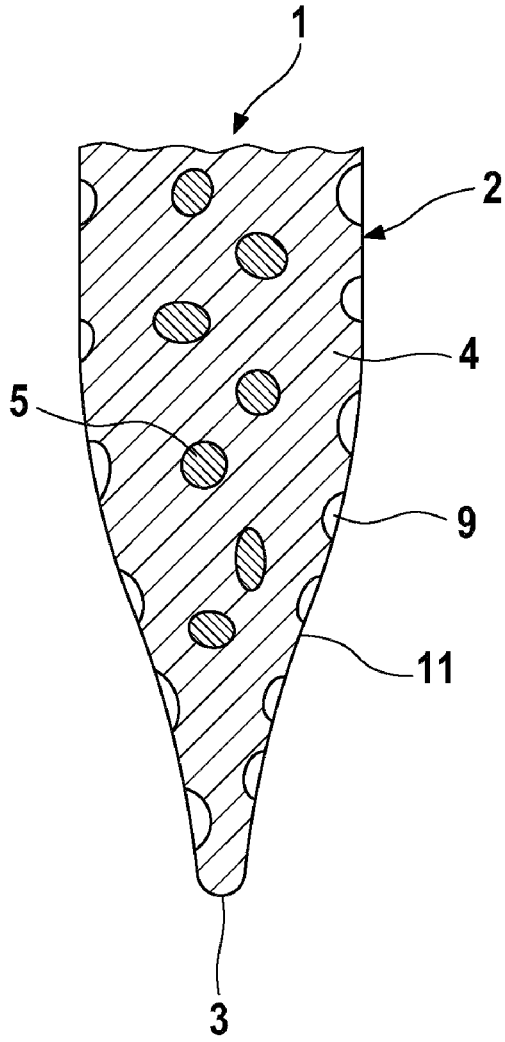
Figure 5:
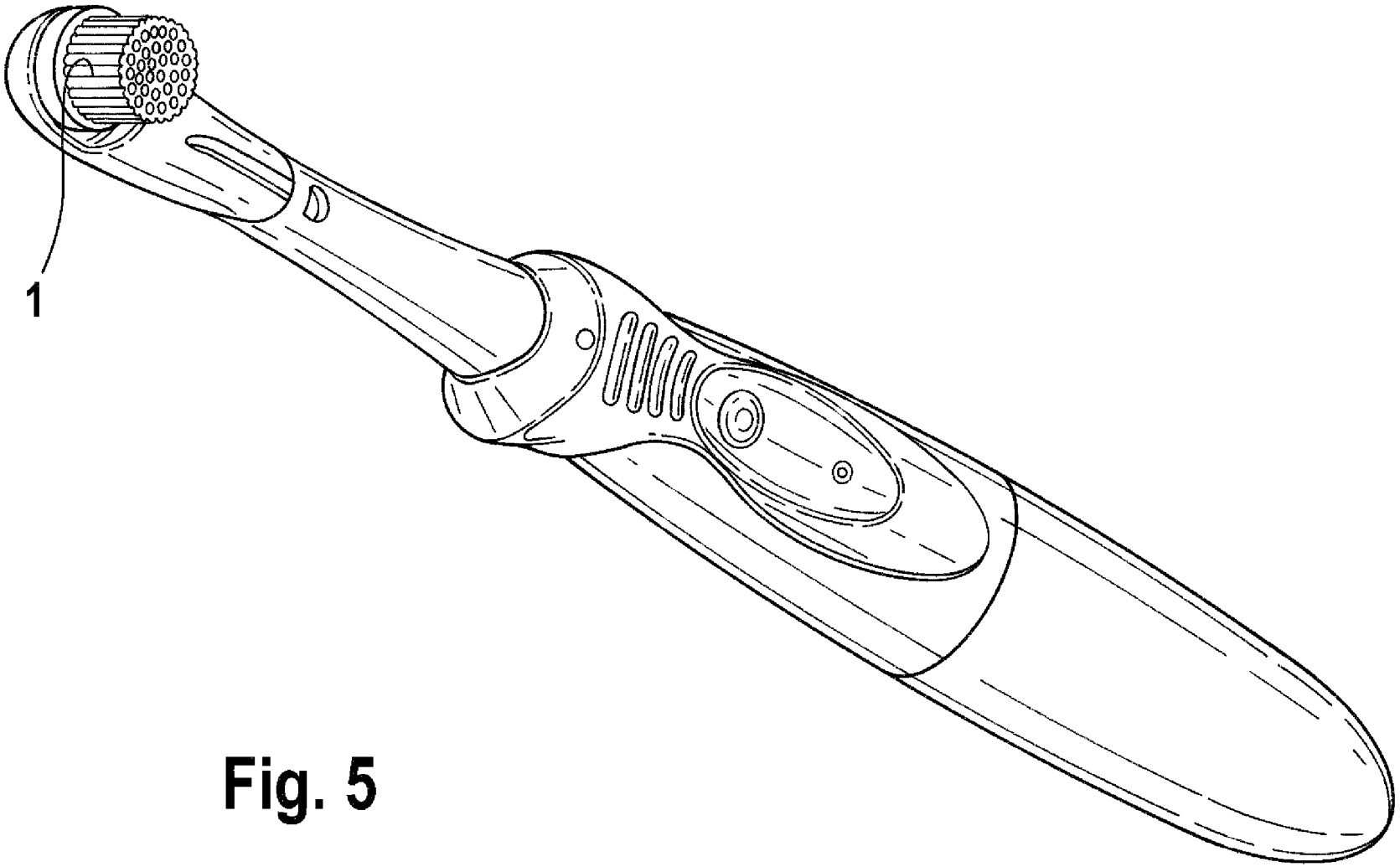

These and other features of the present invention are also derived from the following description and/or the respective drawings in addition to the claims, whereby the features in various combinations and subcombinations or individually may form the subject matter of the present invention, regardless of how they are combined in the claims. The invention is explained in greater detail below on the basis of preferred exemplary embodiments and the respective drawings. In the drawings:

FIG. 1 shows a schematic longitudinal section through a toothbrush filament in whose matrix material grains having a shell structure are embedded, the grain shell having been etched and the core having been partially etched away, FIG. 2 shows a schematic longitudinal section through the toothbrush filament like that in FIG. 1 according to another embodiment of the invention, whereby grains having a shell structure are embedded in the matrix material of the toothbrush filament containing an application substance as the core, FIG. 3 shows a schematic longitudinal section through a toothbrush filament according to another advantageous embodiment of the invention according to which grains of a material that is less resistant to etching are embedded in a matrix material, which is more resistant to etching, and recesses are formed in the surface of the toothbrush filament by greater etching of the grains, FIG. 4 shows a schematic longitudinal section through a toothbrush filament like that in FIG. 3, whereby the grain material is completely etched away in the recesses and the recess bottom is formed by the matrix material, and FIG. 5 shows a schematic perspective view of a toothbrush with a brush field of toothbrush filaments according to FIGS. 1 through 4.

The toothbrush filament 1 shown in FIG. 1 has an essentially elongated cylindrical filament body 2, in which the one end section is designed to taper conically toward the tip 3.

The filament body 2 consists of a matrix material 4 in which a plurality of grains 5 are embedded, providing the filament body 2 with a surface structure having numerous warts and/or holes in the manner of a grid-type relief. As shown in FIG. 1, the grains 5 have come to the surface due to an etching process and are only partially embedded in the matrix material 4, so that they are elevated with a portion of their granular body to protrude above the surface of the matrix material.

In the embodiment according to FIG. 1, the grains 5 have a shell structure. A grain shell 6 encapsulates a core 7 made of a different material in comparison with the grain material. The grain shell 6 consists of a relatively etching-resistant material, such as aluminum oxide $Al_2O_3$ or silicon dioxide $SiO_2$, while the core 7 is made of a material such as chalk, which is eroded to a greater extent than the grain shell 6 during etching. The etching resistance of the grain shell 6 is also advantageously higher than the etching resistance of the matrix material 4, so that by etching the filament body 2 the grains 5 can be partially exposed in the form shown in FIG. 1 by eroding the matrix material 4 to a greater extent than the material of the grain shell 6. This partial exposure of the grains 5 in etching the filament body advantageously takes place then, at which point the body is given the conical taper 11 illustrated in FIG. 1.

As FIG. 1 shows, in etching the toothbrush filament 1, the grain shell 6 of the grains 5 designed with a shell structure is etched to the extent that an opening 8 is formed in the shell through which the core 7 is then also exposed to the etching medium. Due to the lower etching resistance of this core 7, the core is eroded to a greater extent than the shell 6 of the grain, so that the shell and/or cup-shaped contour of the grains 5 shown in FIG. 1 is obtained, forming on the one hand an elevated protrusion 12 above the matrix material 4 and, on the other hand, defining a pan-shaped concavity and/or recess 9 which is bordered by said shell opening 8. In the embodiment shown in FIG. 1, the recess bottom 10 is formed by the material of the core 7, which has not been completely etched away. As an alternative to the embodiment shown here, it would also be conceivable for the core material to be etched away completely, so that only a portion of the grain shell 6 remains.

The diameter of the grains 5 in the embodiment illustrated here is advantageously between 0.001 mm and 0.1 mm. The thickness of the grain shell 6 is advantageously between 0.001 and 0.05 mm.

In the embodiment shown in FIG. 2, grains 5 with a shell structure are also embedded in the matrix material 4 of the filament body 2. The grains 5 comprise a core 7 of an active ingredient, preferably chlorhexidine, triclosan, fluoride or a flavoring agent or flavoring agent mixture encapsulated by a grain shell 6, which is made of a material that is not attacked at all in etching or is attacked only slightly. The material of the grain shell 6 may be, for example, aluminum oxide $Al_2O_3$ or silicon dioxide $SiO_2$. The diameter of the grains 5 is advantageously between 0.001 and 0.1 mm. The thickness of the grain shell 6 is between 0.001 and 0.05 mm. In contrast with the embodiment according to FIG. 1, the grains 5, in particular their grain shell 6, are not broken up by etching so the encapsulated active ingredient initially remains encapsulated. In etching, only matrix material 4 is removed to the extent that the aforementioned grains 5 protrude in an elevated manner as shown in FIG. 2 and form protrusions 12. In brushing the teeth, the aforementioned grain shell 6 is then broken due to the mechanical load, so the encapsulated active ingredient of the grains 5 is released.

The embodiment of a toothbrush filament 1 illustrated in FIG. 3 also comprises a plurality of grains 5 which are embedded in the matrix material 4 of the filament body 2. In contrast with the embodiments shown in FIGS. 1 and 2, the grains 5 in FIG. 3 do not have a shell structure but instead are made of a material such as chalk which is much less resistant to etching in comparison with the matrix material 4 and is worn away to a much greater extent than the matrix material 4 in etching with a suitable etchant. Therefore, the grains 5 form recesses 9 in a negative image, their bordering edges 10 capable of scraping off plaque. Moreover, the recesses 9 define pockets for holding toothpaste and/or toothpaste foam, so that the latter is distributed in an excellent manner.

The diameter of the grains 5 and/or the recesses 9 forming a negative image of the grains may advantageously amount to between 0.001 and 0.1 mm, with a depth of the recesses between 0.0005 and 0.05 mm. As FIG. 3 shows, the grains 5 are not completely etched away, so the bottom of the recess is formed by the residue of the grain material.

As an alternative to this, the grain material may also be etched away completely as illustrated in FIG. 4. Moreover, the embodiment according to FIG. 4 otherwise corresponds to the embodiment according to FIG. 3.

In the embodiments of the toothbrush filament 1 shown in FIGS. 1 through 4, it has a free end section 11 with a conical taper and a circular cross section which can be preserved by etching the matrix material 4. The tapering end of the toothbrush filament 1 easily penetrates into interdental spaces, where the surface structure created by the grains 5 improves the cleaning effect. If the grains 5, in particular in the elevated embodiment according to FIGS. 1 and 2, are made of a hard material, then the grains 5 act as a polishing agent against the dental calculus. With the recess-shaped embodiments according to FIGS. 3 and 4, the edges of the recesses can scrape away plaque.

As shown in FIG. 5, the toothbrush filaments 1 may be combined in bristle clusters and/or a bristle field in a known manner and may be arranged on the bristle body of an electric toothbrush, for example, on which the bristle field is driven with oscillation.

What is claimed is:

1. A toothbrush filament with a filament body comprising a matrix material in which grains are embedded, characterized in that the grains have a shell structure and comprise a grain shell wherein the grain shell comprises a shell material, which surrounds a grain core of a core material that is different from the shell material;

wherein the core material of the grain core has a lower etching resistance than the shell material of the grain shell and wherein grain shells that are partially abraded are provided on the surface of the filament body, surrounding a concave recess in the respective grain.

2. The toothbrush filament according to claim 1, wherein the matrix material and the grains have a different etching resistance so that by etching the matrix material and/or the grains a surface structure can be created on the filament body.

3. The toothbrush filament according to claim 1, wherein the recess surrounds a recess bottom of the core material.

4. The toothbrush filament according to claim 1, wherein the recess comprises a recess bottom of the shell material.

5. The toothbrush filament according to claim 1, wherein the core material of the grain core comprises at least one of an application substance for tooth care or an application substance for oral care.

6. The toothbrush filament according to claim 5, wherein the application substance comprises at least one of chlorhexidine, triclosan, fluoride or a flavoring substance.

7. The toothbrush filament according to claim 1, wherein the shell material of the grain shell comprises at least one of aluminum oxide, silicon oxide or compounds thereof.

8. The toothbrush filament according to claim 1, wherein the grains have a diameter of from 0.001 mm to 0.1 mm.

9. The toothbrush filament according to claim 1, wherein the grain shell has a wall thickness of from 0.001 mm to 0.05 mm.

10. The toothbrush filament according to claim 1, wherein at least some of the recesses have a recess bottom formed by the matrix material.

11. The toothbrush filament according to claim 1, wherein the grains comprise chalk.

12. A toothbrush having a toothbrush field, wherein the toothbrush field contains a plurality of toothbrush filaments according to claim 1.

* * * * *